US009045887B2

(12) United States Patent
O'Malley

(10) Patent No.: US 9,045,887 B2
(45) Date of Patent: Jun. 2, 2015

(54) MECHANICAL TRAP TOILET WITH DUAL FLUSH OF SOLID WASTE FOR WATER EFFICIENCY

(75) Inventor: Conor O'Malley, San Diego, CA (US)

(73) Assignee: Grace O'Malley, Trustee, Jenner, CA (US)

( * ) Notice: Subject to any disclaimer, the term of this patent is extended or adjusted under 35 U.S.C. 154(b) by 851 days.

(21) Appl. No.: 13/244,359

(22) Filed: Sep. 24, 2011

(65) Prior Publication Data

US 2012/0246817 A1 Oct. 4, 2012

Related U.S. Application Data

(63) Continuation of application No. 13/066,891, filed on Apr. 26, 2011, now abandoned, which is a continuation-in-part of application No. 12/151,015, filed on May 2, 2008, now abandoned.

(51) Int. Cl.

| | |
|---|---|
| ***E03D 11/00*** | (2006.01) |
| ***E03D 5/012*** | (2006.01) |
| ***E03D 11/10*** | (2006.01) |

(52) U.S. Cl.

CPC ..... *E03D 5/012* (2013.01); *E03D 11/10* (2013.01); *E03D 2201/40* (2013.01)

(58) Field of Classification Search

USPC ..... 4/441, 434–439

See application file for complete search history.

(56) References Cited

U.S. PATENT DOCUMENTS

| | | | | |
|---|---|---|---|---|
| 4,246,666 | A * | 1/1981 | Stansbury, Jr. | 4/438 |
| 5,007,117 | A * | 4/1991 | Oldfelt et al. | 4/432 |
| 5,570,477 | A * | 11/1996 | Rodriguez | 4/213 |
| 6,081,938 | A * | 7/2000 | McClure et al. | 4/325 |
| 6,332,229 | B1 * | 12/2001 | O'Malley et al. | 4/438 |

* cited by examiner

*Primary Examiner* — Lauren Crane

(74) *Attorney, Agent, or Firm* — David Pressman

(57) ABSTRACT

A toilet to reduce water consumption for waste disposal. One embodiment uses a toilet which has a frustum-shaped bowl, whose outlet can be hermetically sealed by a saucer-shaped valve, wherein the bowl contains no water. In one embodiment, a user who deposits only urine can depress one button to automatically open the saucer vertically down and rinse and flush the urine into an adjoining drain line with about 250 ml (0.25 gallon) of water. If the user deposits solid waste, another button is depressed to release a staggered flush (first and second quantities of water) capable of causing solid human waste, test plastic balls, or equivalents to carry further in an adjoining drain line.

18 Claims, 12 Drawing Sheets

MECHANICAL TRAP TOILET WITH DUAL FLUSH OF SOLID WASTE FOR WATER EFFICIENCY

CROSS-REFERENCE TO RELATED APPLICATIONS

This application is a continuation application and claims priority from a U.S. utility patent application, Ser. No. 13/066,891, filed Apr. 26, 2011, entitled "Mechanical Trap Toilet and Staggered Drain Carry," abandoned, which in turn was a continuation-in-part of the application entitled "Mechanical Sealable Rapid-Opening Stagger-Flush Residential Toilet," Ser. No. 12/151,015, filed May 2, 2008, abandoned.

BACKGROUND

Prior Art

The following definitions and background information will help make this description clearer and easier to understand so that a reader can appreciate why a mechanical trap toilet can meet numerous technical standards, or their functional intent, required by the Uniform Plumbing Code.

Air Gap

ASME (American Society of Mechanical Engineers) Standard A 112.1.2.-1991 defines an air-gap as an unobstructed vertical distance through open atmosphere between the lowest opening from a pipe supplying water from a water supply to a toilet bowl and the highest level in the bowl to which water or waste may rise. The minimum ASME requirement is 50 mm (≈2 inches). The European Union's equivalent minimum dimension is 20 mm (≈0.8 inch).

Artificial Test Media

Test media acceptable to the ASME are used by the International Association of Plumbing and Mechanical Operators (IAPMO), toilet-rating laboratories, manufacturers, and inventors to determine the ability of a toilet to expel solids from a toilet bowl in laboratory drain lines. They include standardized polyethylene balls. Toto of USA pioneered the use of condoms of standard capacity filled with tofu of standard weight, also known as sausages.

American Society of Mechanical Engineering (ASME)

The ASME is a professional organization which defines the physical, functional, and health requirements of the Uniform Plumbing Code. A rating agency such as the IAPMO is used to determine if a given toilet can legally be offered with the latter's rating for sale in many US states and Canada.

Conflicts Caused by Water Shortages

Political disputes and warfare have occurred due to water shortages. They are exemplified by the following broadcast on Public Service Television (PBS), "Your Majesty, Jordan has had great relations with Israel? Can you imagine going to war with Israel for any reason?" The late King Hussein replied, "Yes, water."

Conventional Toilets

Conventional toilets that may currently legally be offered for sale for residential and business use in the United States are of two kinds, (1) those characterized by siphon waste passageways, and (2) those characterized by wash-down waste passageways.

Corrosion

Corrosion includes erosion, pits, crevasses, etc., due to numerous corrosive acids and alkalis acting on most metals, plastics, and elastomers.

Drain Lines

Drain lines are pipes that slope from a toilet to a septic tank, a sewer that discharges into a waste treatment plant, or a receptacle in a laboratory. Ideally, gravity, augmented by automated pumps, water toilets, and water from sources other than toilets can propel, i.e., carry, human waste to a waste treatment plant. Toilet manufacturers and inventors use laboratory drain lines, which are seamless and from which about a third of the uppermost structure has been removed, so that laboratory personnel can see, measure, and report drain line carry with artificial test media, as described below.

Drain Line Carry

Drain line carry is the ability of a given toilet to propel human waste (1) to a septic tank, (2) to a sewer, or (3) to propel artificial test media from the toilet to a receptacle in a laboratory. Laboratory personnel measure drain line carry to determine whether the toilet can legally be offered for sale in a business or residence. Since solid human waste varies from person to person and over time, it is not readily possible to measure how well it carries. Consequently, the ASME has devised a laboratory measuring method, defined in Section 8.8 of their Standard A 112. 19.2-2003, which depends on laboratory personnel being able to see and measure how well 100 standard polypropylene balls carry in an seamless pipe which has an inside diameter of 100 mm (4 inches) and a straight run that inclines downward at a 2% angle from the toilet. To be legal to sell a toilet for use in a residence or business with an ASME rating, the toilet must be able to carry the balls a minimum average distance of 12.2 meters (40 feet) with no more than 6 liters (1.6 gallons) of water. Toilets that exhibit greater carrying power in a laboratory drain line are prized (A) because they can lower the private costs of maintaining standard drain lines, and (B) because they can lower the costs of maintaining, repairing sewers, upgrading sewers and sewage plants, and to combat odor. For example, combating odor can cost San Francisco alone $100 million during a 5-year period. San Francisco may have to pump 8.5 million pounds of bleach into its sewers to combat odors, and thereby further damage its own sewers and sewage treatment plants. Repairing or enlarging a sewage treatment plant for a city as large as San Francisco can cost billions of dollars.

Dual-Flush Toilet

A toilet that permits a person to use less water for urine than solid human waste.

Flush

A flush is an action that will evacuate the contents of a toilet bowl into an adjoining drain-line.

Flushometer Valve

A valve that controls passage of pressurized water to a toilet bowl.

Frustum-Shaped Bowl

A bowl having an inside surface without concavities or convexities and inclined so that human waste is less likely to adhere to the surface and more readily detached with less rinse water.

Full Flush

The ability of a given toilet to flush an adjoining drain line. To earn an IAPMO rating a full flush must be able to carry 100 standard polypropylene test balls an average of at least 12.2 meters (40 feet) in an adjoining drain line that slopes downward from the toilet at an angle of 2%. If it cannot, the toilet may not legally be offered for sale in a residence or business.

Free Fall

Downward movement of bowl contents from a bowl via a waste passageway into an adjoining drain line under no force other that of gravity, there being no thrust or drag other than that of the bowl.

Gallon

One U.S. Gallon is equivalent to 3.78 liters.

International Association of Plumbing and Mechanical Operators-IAPMO

A for-profit corporation, headquartered in Ontario, Calif., which rates whether a new toilet brand meets ASME standards. If it does, it receives an IAPMO rating. The market for IAPMO rated toilets and toilets that meet other stringent standards is large, at least ten times greater than that for RV, boat, etc., toilets. For example, at least three or four companies that sell siphon toilets gross more than three billion US dollars a year and thereby have cash flows so large that American Standard Brands sold its toilets at a loss for ten years. According to verbal communication with an ASME engineer and an IAPMO official, inventors and makers periodically submit mechanical trap toilets to IAPMO. As of 2008, no mechanical trap toilet received an IAPMO rating, which is needed in order to be legally offered for sale as a residential or business toilet.

Laboratory Drain Line

A drain line, in a private or for-profit laboratory, used by inventors and testing authorities for observing the ability of a toilet to carry simulated human waste, such as ASME-rated balls, but never solid human waste, towards, or into a receptacle.

Maintenance Costs of Wasting Water

On-going costs for maintenance, labor, and replacement of upstream and downstream infrastructures due to inefficiencies in water usage. These costs for one large city can exceed hundreds of millions of dollars. The cumulative costs of oil, gas, coal, and energy substitutes needed to pump water to toilets sometimes hundreds of miles away, and from toilets, are vast. Such costs and health and welfare losses to air, water, and row crop pollution by electric pumps, leaks, and effluents are all increasing.

Mechanical-Trap Toilet

A toilet that has a trap or valve that can be opened and closed mechanically against a bottom outlet of a toilet bowl for allowing or preventing the contents of the bowl from exiting the toilet.

Psychological Costs of Wasting Water

The psychological costs include mental anguish by wasting water. Such psychological detriments can include losing one's neighborhood to a water reservoir or a wastewater treatment plant or losing opportunities to enjoy pristine terrain, such as valleys, streams, rivers, and countryside. These losses can affect current and unborn generations.

Rebates

Rebates are payments by water districts in the United States to encourage those who own toilets to replace them with ones that use less water. In addition, some water districts and cities, such as the London, England, exchange tens of thousands of more water-saving toilets to avoid having to borrow and having to spend billions to build new water reservoirs or waste treatment plants or to enlarge old ones.

Reduced Flush

A reduced flush is a flush which can expel urine with or without toilet tissue from a toilet bowl but not feces.

Rinse

A rinse is an attempt to use water to detach adherent toilet tissue, or solid human waste, from the inside of a toilet bowl.

Siphon and Wash-Down Toilet History

Since the invention of siphon and wash-down toilets about 200 years ago, apparently no significant sanitary toilet authority, or agency, such as today's IAPMO, which protects the health of consumers using toilets and how well the toilets function, has certified a mechanical trap toilet for use in a residence or business, at least as of 2008.

Spillway

An opening in an upper part of a toilet bowl that permits an over-flowing toilet bowl to discharge into a bathroom. The top of the spillway is the lowest part of Air Gap that can prevent human waste from coming in contact with water outlets.

Staggered Flush and Drain Line Carry

A staggered flush is a method for enhancing drain line carry using flush water to urge solid human waste, the above mentioned ball, or tofu-filled condoms, from behind while they are moving in a drain line. This enhancement employs the principle that it takes less energy to keep an object in motion than to re-start it once it has come to rest.

Toilet Advocates

Toilet Advocates are politically powerful ecological interest groups that seek to influence the federal government to enact laws that encourage ever-more water saving toilet technology. In 1992 they persuaded Congress to mandate that a full flush may not use more than 6.0 liters (1.6 gallons). Other politically powerful toilet advocates include departments of city, state, and federal governments, plus local and regional water districts responsible for financing the construction and maintenance of numerous new water reservoirs and waste treatment plants needed by burgeoning urban populations. Toilet advocates also include influential public-interest organizations, such as the California Urban Water Council, the Sierra Club, a variety of green organizations, and the water-conservation arms of U.S. cities, states, and federal governments. The list also includes the federal government itself and numerous city and state governments that must pay for toilet water used by numerous millions of civil servants, students, citizens, and armed personnel. Studies show that regulation of toilets by the United States Government in an attempt to save water, despite objections of makers, plumbers, etc., has had significant adverse impacts on the functional efficiency of conventional toilets.

Uniform Plumbing Code (UPC)

The UPC defines minimum functional and material attributes of toilets that can legally be offered for sale in the US. IAPMO the UPC for numerous plumbing jurisdictions in Canada and many U.S. states. A committee composed of IAPMO officials, ASME engineers, representatives of toilet companies, toilet jurisdictions, etc., updates the UPC bi-yearly to reflect new plumbing developments. A maker who wishes to receive a rating for a toilet may submit Interim Guide Criteria to the committee charged with updating the UPC. The maker's criteria should include enough detailed instructions to the UPC Interim Guide Committee how an IAPMO laboratory can test and prove to the satisfaction of the committee that the maker's proposed toilet and its innovation toilet are worthy of further consideration. If the Interim Guide Criteria committee is satisfied, the maker must submit a model of the toilet for rigorous laboratory testing by IAPMO, or an affiliated laboratory. Should the toilet passes all required tests, the committee instructs IAPMO to permit the maker to offer it for sale with its rating in any state, province, or water district that honors the rating.

IAPMO informs us it has tested numerous mechanical trap toilets but as of 2008, none have earned its rating.

Urine

Urine is highly complex aqueous solution of organic chemicals that can corrode many man-made materials.

Volume Of Water Per Person Per Day

A volume of water per person per day is the water used by a specific toilet to satisfy the toilet needs of an average person. Medical science and the toilet industry assume the average person defecates once and urinates four times a day. The average toilet in the US, Canada, Japan, and Europe uses at least 30 liters (8 gallons) per person per day. Some conventional dual-flush toilets use 18 liters (4 gallons).

Waste Passageway

A waste passageway is the part of a toilet between the bottom outlet of a bowl and an adjoining drain line. (1) Normally water in the bottom of the bowl of a siphon and wash-down toilet can prevent potentially toxic and explosive gases from entering bathrooms from adjoining drain lines. However, the water can evaporate and, furthermore, it cannot prevent sewage from backing up from the drain line and, (2) A rotational mechanical trap, which is normally hermetically sealed against the bottom outlet of the bowl, prevents potentially toxic and explosive mixtures of sewer gases from entering a bathroom from an adjoining drain line. It can prevent some sewage from backing up into the bathroom. In contrast, the waste passageways of siphon and wash-down toilets are less than optimal.

Wet Spot Or Plash

A quantity of water in a toilet bowl which is wide or deep enough to slow the momentum of falling feces is called a wet spot, puddle, or plash. It can prevent feces from sticking to the bowl, or it may permit them to stick less firmly so that they can be more readily be rinsed off. The UPC requires that a wet spot should have a surface area equal to, or greater than, 123×100 mm (5×4 inches) and be 50 mm (2 inches) or more deep.

Viton

Viton is a trademark for an extremely resilient and corrosion resistant elastomer, made and a sold by du Pont.

Water Seal

As mentioned, a water seal occurs when the quantity of water in a toilet bowl is sufficient to prevent volatile sewer gases, at atmospheric pressure, from rising into a bathroom. Furthermore, significant pressure or suction in an adjoining drain line can undo a water seal in conventional toilets, so that those nearby are no longer protected from sewer gases. However, water seals are less than optimal.

Mechanical Trap Toilets

Grech et al., in U.S. Pat. No. 6,871,361, filed Mar. 29, 2005, show a conventional mechanical trap toilet which can expel human waste only a few inches from its bowl, into a black-water holding tank under the floor of an RV, or a few inches into a lake or sea from a boat. Its ability to carry human waste further than a few inches is less than optimal.

Water Outlets

Prior-art toilets almost exclusively have a plurality of water outlets, each of which is oriented to rinse toilet bowls with pressurized water in roughly the same direction, usually clockwise. For example, O'Malley et al, in U.S. Pat. No. 6,332,229, filed Dec. 25, 2001, shows a toilet bowl which has at least two water outlets which rinse in the same direction. Huffman et al., in U.S. Pat. No. 5,715,544, filed Feb. 10, 1995, show water outlets that rinse in the same and opposite directions. Heinze, in U.S. Pat. No. 4,404,696, filed Sep. 20, 1983, shows one or more multi-channel water outlets that rinse a bowl in three directions, forward, rearward, and downward. Ament, in U.S. Pat. No. 4,930,167, filed Jun. 5, 1990, shows pressurized water flowing in opposite directions within the rim of a toilet. Brower, in U.S. Pat. No. 5,123,124, filed Jun. 23, 1992, shows a toilet bowl rinsed by rotating water outlets. Nakamura et al, in U.S. Pat. No. 6,145,138, filed Nov. 14, 2000, show an upper part of a toilet bowl shaped so that pressurized water rinses the bowl in opposite directions. Hargraves, in U.S. Pat. No. 4,075,718, filed Feb. 28, 1978, shows complex multi-channel high pressure nozzles. Grech et al., supra, show two water outlets. One outlet automatically jets pressurized water along a ledge (20) on one side of an upper part of a bowl in one direction. Then, the water flows over the edge of the ledge to rinse a remainder of the bowl. The other water outlet automatically rinses a second ledge and the other side of the bowl in a similar manner. However, the water outlets do not efficiently rinse an area of toilet above the ledge. Consequently they cannot pass the Surface Wash Test of ASME Standard A 112.19.2-2003, Sec. 8.6, that requires the bowl be rinsed to one inch (25 ml) below the outlets. The outlets are widely separated at the rear of the toilet; consequently they cannot rinse the rear of the bowl, where, due to the parallel bi-lobed shape of the human buttocks, feces are more apt to adhere. Consequently, the configuration of the toilet bowl and its water outlets, taught by Grech et al., supra, are less than optimal.

Spillways

Schnitzler, in Swiss Pat. No. CH10222, filed Mar. 13, 1898, and Kimble, in U.S. Pat. No. 988,787, filed Apr. 4, 1911, both show toilets having spillways in upper parts of bowls. The spillways can help prevent human waste from overflowing onto floors. However, the spillways are too close to water outlets to meet ASME Standard A 112.1.2-1991. This requires that there be a sufficiently wide unobstructed air gap between water in a toilet and water entering from a water supply to prevent contamination of the drinking water if there is negative pressure in the conduit that delivers drinkable water to the toilet.

Economic and Ecologic Costs of Toilet Water

Prior-art flush toilets currently use 28% of water used indoors in the U.S. Water reservoirs are required to store water so that there is enough on hand for towns and cities when needed. Waste treatment plants are required for sterilizing sewage and used indoor water. Reservoirs and waste treatment plants can be vast in area and frequently cost one or more billion dollars each. Many citizens do not want them in their neighborhood. Toilets in U.S. commercial buildings use about 1.2 billion gallons (4.6 billion liters) of water a day, the equivalent of the capacity of 48 full-sized water reservoirs a year. It can cost as much to enlarge a water storage reservoir as to build one. E.g., it cost approximately US $2 billion to build the Eastside Reservoir to double the storage capacity for the Metropolitan Water District of a Southern California. City and regional water agencies normally borrow the initial money from state governments to build or enlarge water reservoirs and waste treatment plants to accommodate burgeoning urban populations. The state governments in turn borrow from the Federal Government. Eventually, taxpayers must repay not only the borrowed billions but interest that can bring their total debt to three times the money borrowed. Current toilets are less than optimal for reducing these financial burdens.

SUMMARY

The present waste disposal system can be implemented in numerous ways, such as in a toilet, or an equivalent waste disposal. Various aspects are described below.

In accordance with one aspect, a toilet bowl has a bottom outlet. A sealing ring surrounds the bowl near the bottom outlet. A rotational saucer-shaped seal is positioned adjacent the bottom outlet at the entrance to a waste passageway. The saucer can be pivoted upward against the sealing ring to hermetically seal the bottom outlet of the bowl. The saucer can be pivoted downward to permit bowl contents to free fall via the waste passageway into an adjoining drain line. An automated two-stage staggered-flush carries human waste or 100 standard balls more efficiently in the adjoining drain line. All parts exposed to urine, feces, or corrosive gas are made of, or coated, by materials resistant to corrosion by the urine, feces, and gas. Moving parts are advantageously mounted with loose tolerances so that they can be operated and the saucer can be opened and closed 75,000 times without losing its ability to pass an array of other ASME tests.

DRAWINGS

Figure 1:
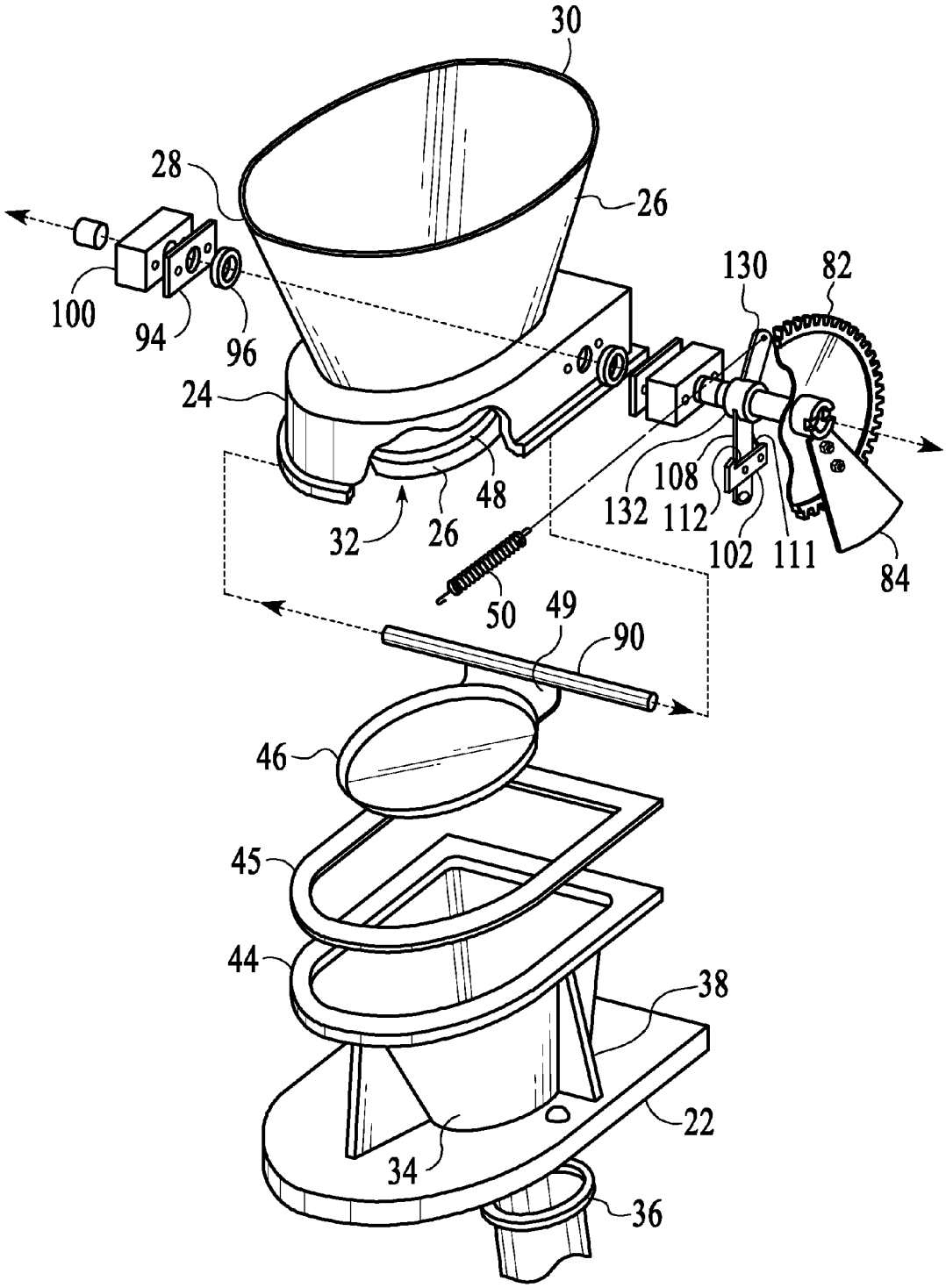
FIG. 1 shows an exploded perspective view from in front and to the right of one embodiment of our toilet bowl, a sealing ring surrounding a lower outside part of the bowl, and a rotational saucer-shaped mechanical trap in an up position.

| DRAWING Reference Numerals |
|---|
| 22 lower support structure |
| 23 ground |
| 24 upper support structure |
| 26 frustum-shaped bowl |
| 28 front of bowl |
| 30 rear of bowl |
| 32 bottom outlet of bowl |
| 34 waste passageway |
| 36 inlet to adjoining drain line |
| 38 reinforcing rib |
| 44 flange of passageway |
| 45 gasket between upper and lower support structures |
| 46 rotational saucer or valve element |
| 47 periphery of saucer 46 |
| 48 sealing ring |
| 49 plate |
| 50 main spring |
| 51 apex of sealing ring 48 |
| 52 pressurized water feed |
| 53 base of sealing ring 48 |
| 54 flushometer valve |
| 56 accessory compartment |
| 60 water conduits |
| 62 opposing water outlets |
| 64 spillway |
| 66 anti-splash ledge |
| 67 wet spot, puddle, or plash |
| 68 rim |
| 70 seat |
| 72 button |
| 74 larger button |
| 76 electric control |
| 77 wall |
| 78 wall |
| 79 motor for opening and closing 46 |
| 80 manual push rod |
| 81 timing belt for 79 |
| 82 timing wheel that rotates freely on 90 |
| 84 cam |
| 86 arm on timing wheel 82 |
| 87 catch on arm 86 |
| 90 saucer-pivoting shaft |
| 91 key |
| 94 gasket |
| 96 hermetic radial seal |
| 100 support bushing |
| 102 trigger |
| 108 second arm connected to hub |
| 109 roller on 108 |
| 111 trigger-centering spring |
| 112 catch on trigger 102 |
| 114 arm connected to roller 115 |
| 115 roller on 114 |
| 116 catch on arm 114 |
| 120 adjusting screw |
| 122 bracket spring |
| 124 bracket |
| 126 electric switch |
| 130 arm connected to spring 50 |
| 132 hub on shaft 90 |
| 134 plate molded into saucer 46 |
| 136 washer and wave washer |
| 138 nut and jam nut |
| 140 stud welded to plate 134 |
| 142 lever that actuates 126 |

ADVANTAGES

Accordingly, several advantages of one or more aspects of the present toilet are as follows: (a) it provides a staggered flush that improves drain line carry, (b) it has no need for a water seal, (c) the bottom outlet of the bowl and the waste passageway are much wider than those of a siphon toilet so the bowl and waste passageway are correspondingly more unlikely to clog, (5) it can't contaminate drinking water, (6) the bowl is unlikely to over flow onto a bathroom, (7) it can meet or surpass all of the historical health and functional advantages of siphon and wash-down toilets, and (8) it is more ecological because it uses much less water per-person-per-day. Furthermore, for all but very small children, a maker can customize the toilet comfortably to seat a customer of any height and weight, or customer subset, by omitting gasket 45 in FIGS. 1 and 2. Also the maker can separate the upper support structure of the toilet from the lower support structure by a vertical distance comparable to the height difference between a four-year-old child and the customer, or customer subset and fusing a sturdy cylinder, that sits on the ground, to the separated upper and lower support structures. The cylinder can blend with bathroom colors other than that of a sink, bath, shower, etc, so that from the doorway of the bathroom, the cylinder mostly hides that the toilet is a toilet and makes the toilet more attractive to the eye.

Further advantages of various aspects will become apparent from a consideration of the ensuing description and accompanying drawings.

Structures and Connections—FIGS. 1, 2, 5*a*, 5*b*

As shown in FIG. 1, a mechanical-trap toilet according to a first embodiment comprises a lower structure 22 that supports the toilet. The lower support structure sits on and is attached to a bathroom floor (not shown) and is connected to a conventional adjoining drain line 36.

A gasket 45 is sandwiched between an upper support structure 24 and a flange 44 of a waste passageway 34. Waste passageway 34 is an integral part of the lower structure.

Figure 2:
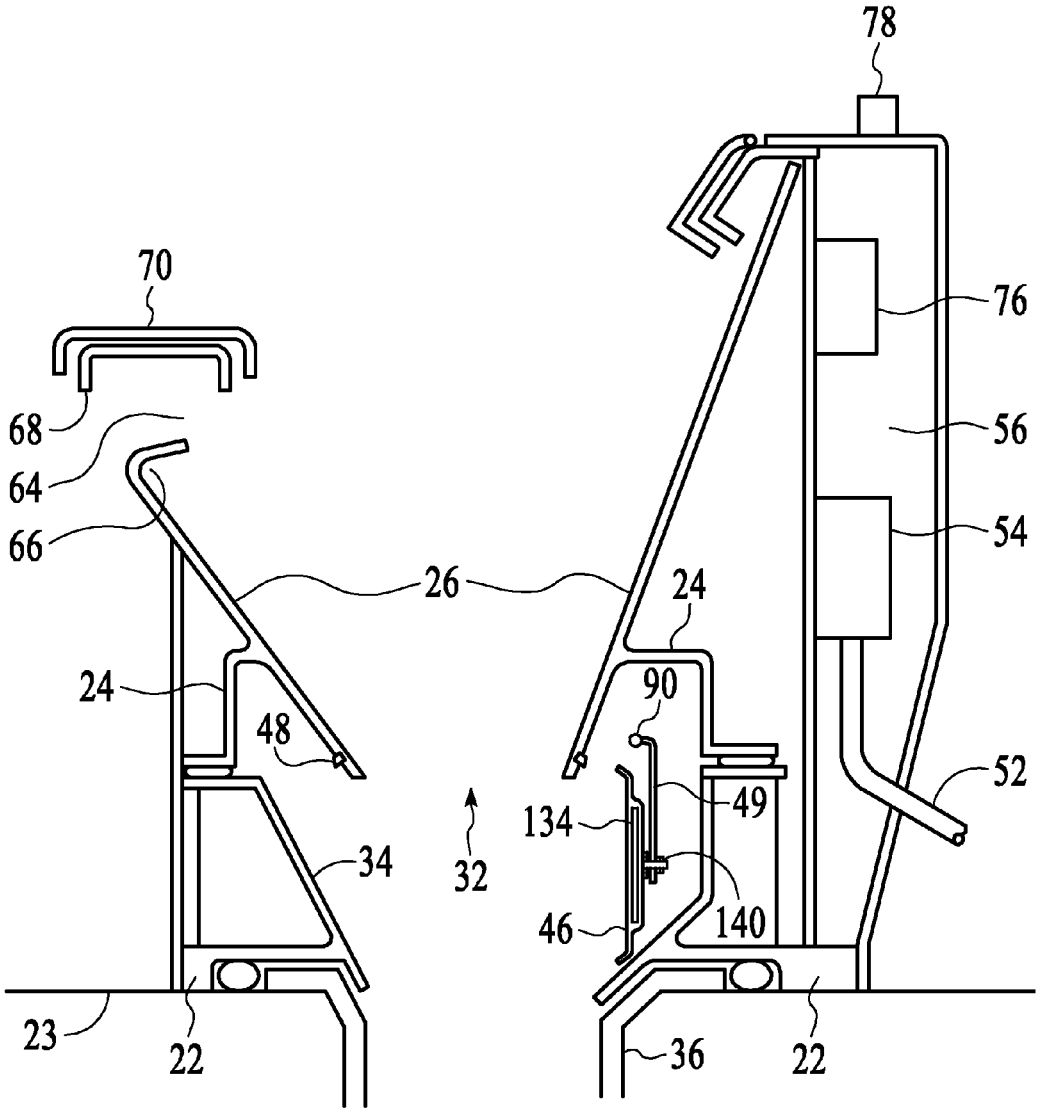
FIG. 2 shows a general view of our assembled toilet in cross section through a center plane from font to rear as viewed from right with the saucer-shaped mechanical trap pivoted down to a fully open position, in accordance with one embodiment.

A bowl 26 is an integral part of the upper support structure. As shown in FIG. 2, the shape of bowl 26 below the level of an anti-splash ledge 66 resembles a frustum, an inverted cone that lacks an apex and ends in a bottom outlet 32.

Figure 5A:
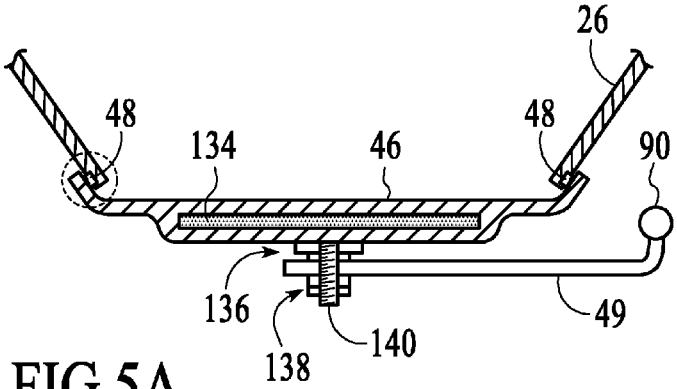
FIG. 5A shows a saucer-shaped mechanical trap, a saucer supporting arm, and saucer-pivoting shaft in cross section with the saucer hermetically compressed against a sealing ring that surrounds the outside of a bottom part of the bowl, in accordance with one embodiment.

As shown in FIGS. 2 and 5A, a sealing ring 48 is press fitted into a groove that surrounds an outside part of bowl 26 above bottom outlet 32.

Reinforcing ribs 38, shown in FIG. 1, help support waste passageway 34, bowl 26, and lower support structure 22.

A saucer-pivoting shaft 90 extends from the right and left sides of upper support structure 24. Shaft 90 is connected to a plate 49. Plate 49 passes forward from sight under a saucer-shaped valve element 46. Plate 49 and valve element or saucer 46 are shown in their fully up, closed positions. Shaft 90 emerges (not shown) from the right and left sides of upper support structure 24. It is surrounded, in order, from inside out, by a hermetic radial seal 96, a support bushing 100, and a gasket 94.

Figure 6:
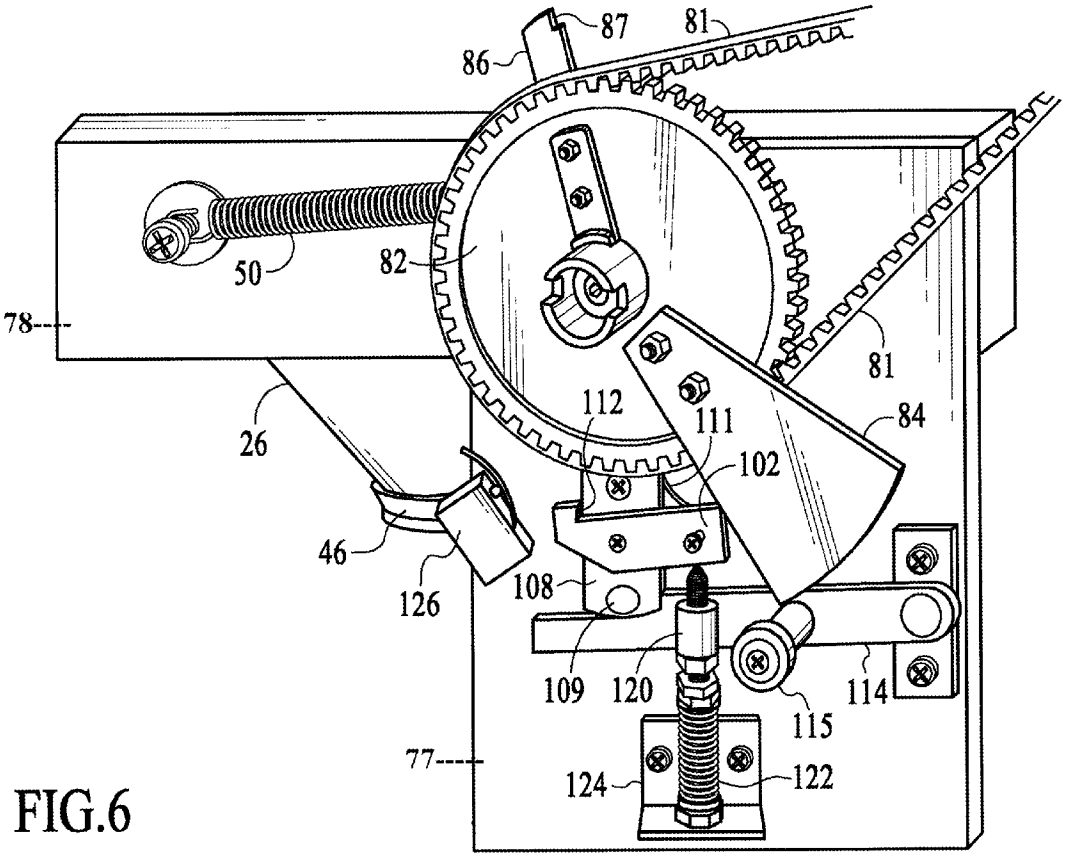
FIG. 6 shows a side view from the right of an external multi-part mechanism for opening and closing the saucer with the saucer normally locked closed, in accordance with one embodiment.
Figure 9:
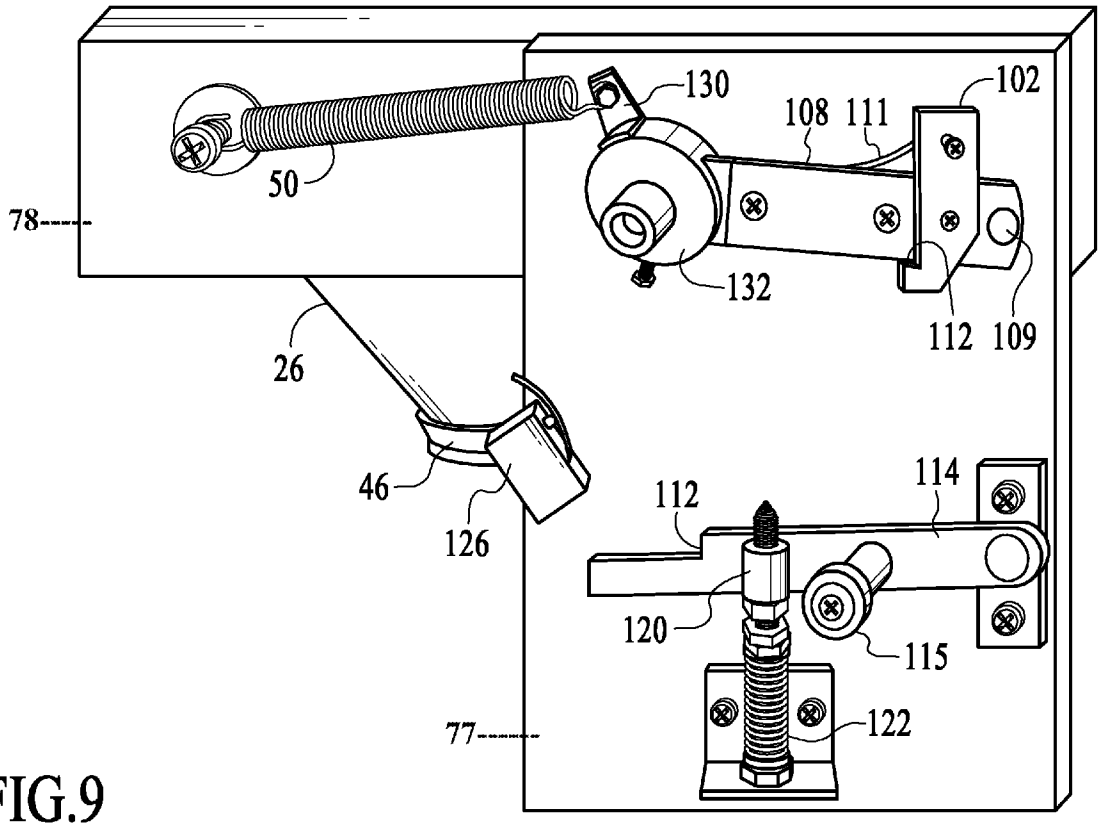
FIG. 9 shows a side view from the right of an external mechanism for opening and closing the saucer, with the saucer open, in accordance with one embodiment.

Shaft 90 is connected to a hub 132. An arm 130 extends radially from the hub. The distal or free end of arm 130 is connected to one end of a coil spring 50. The other end of spring 50 is connected to a wall as also shown in FIGS. 6, 7, and 9.

A second arm 108 (FIG. 1) extends down from hub 132. Arm 108 is connected to a trigger 102. One end of trigger 102 is formed as catch 112, also shown in FIGS. 6 to 10 and 11. The other end of trigger 102 is connected to one end of trigger-centering spring 111. The other end of spring 111 is connected to arm 108, as shown in FIGS. 6, 7, 8, 10, and 11.

Figure 3:
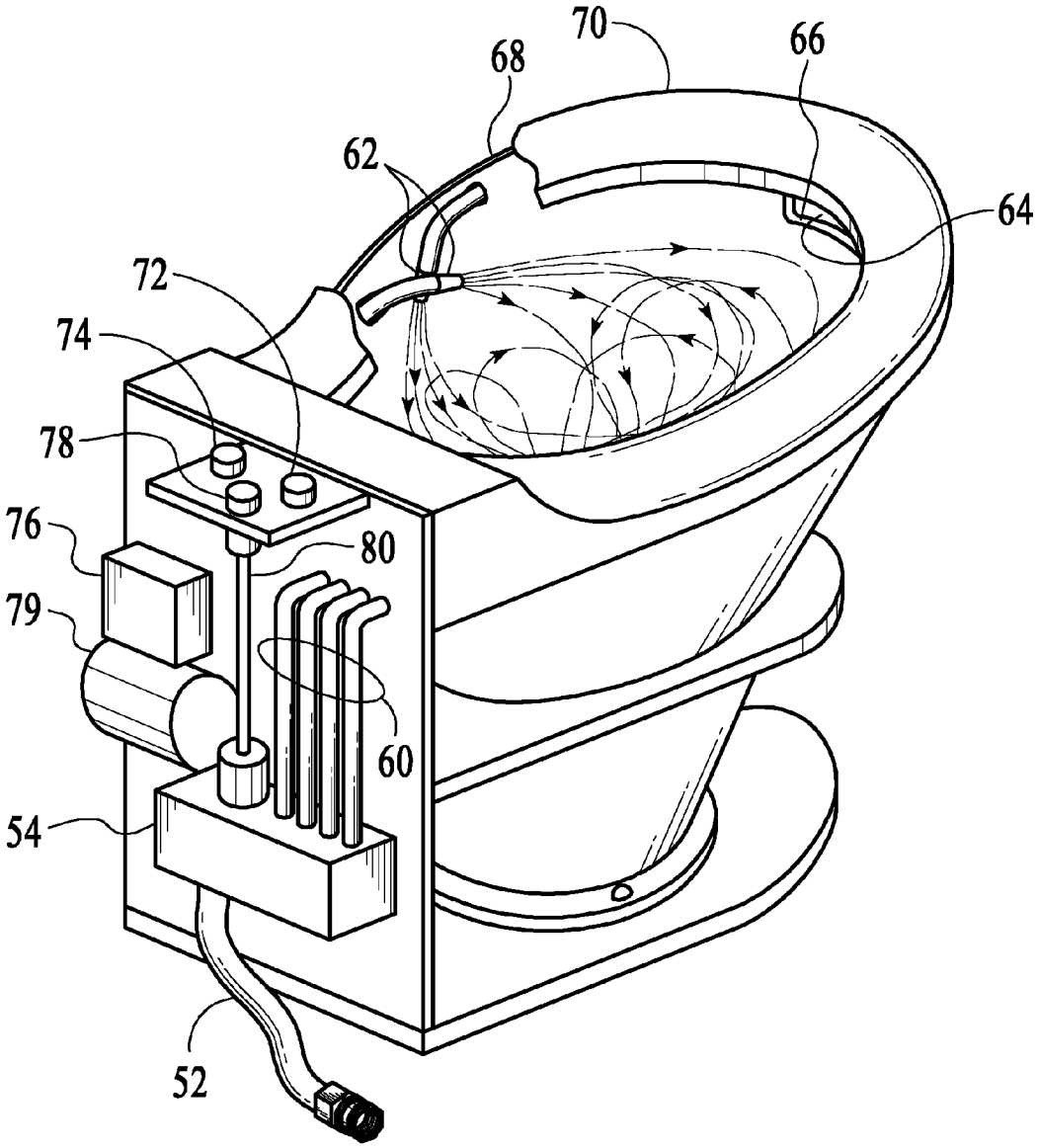
FIG. 3 shows a perspective view from above and behind of electrically and manually operated controls, water connections, and spatial relationship of a pair of water conduits and opposing water outlets, in accordance with one embodiment.
Figure 7:
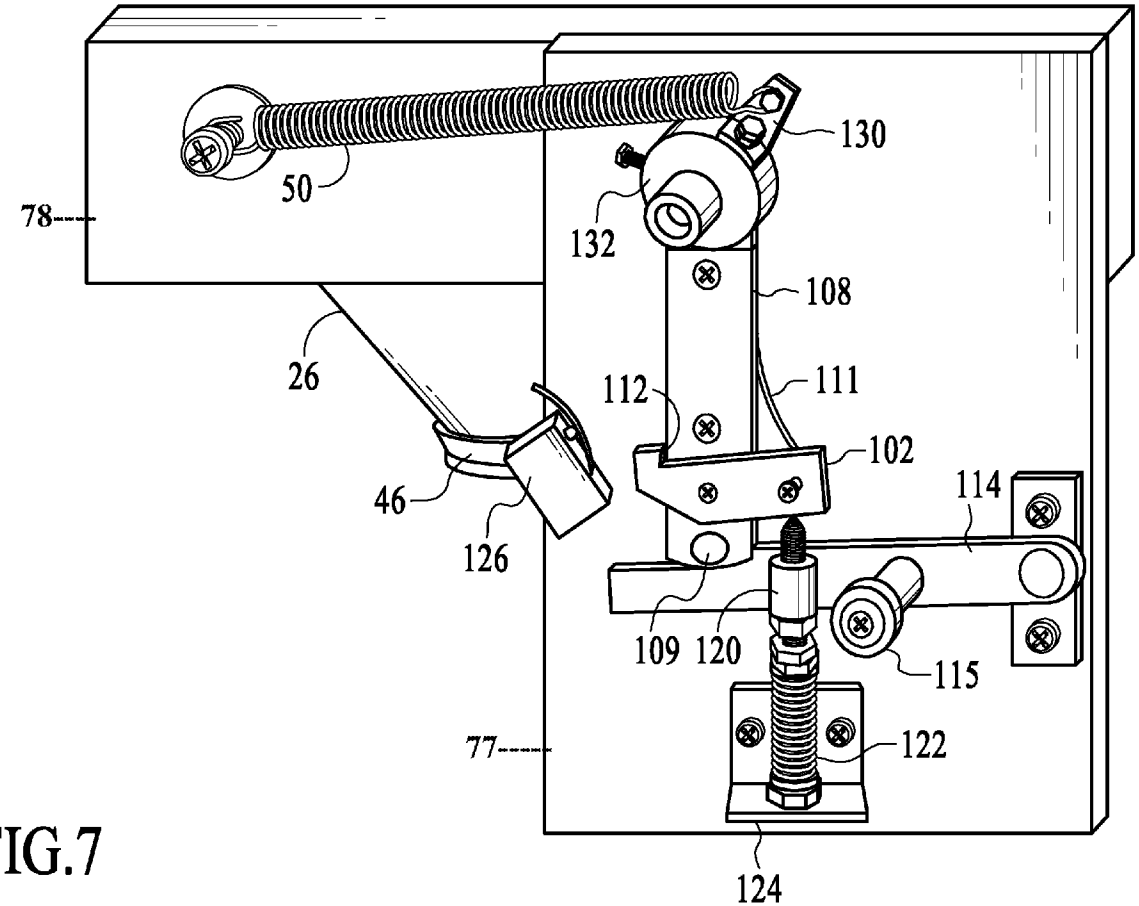
FIG. 7 shows a view similar to FIG. 6, without the timing wheel or timing belt, in accordance with one embodiment.
Figure 8:
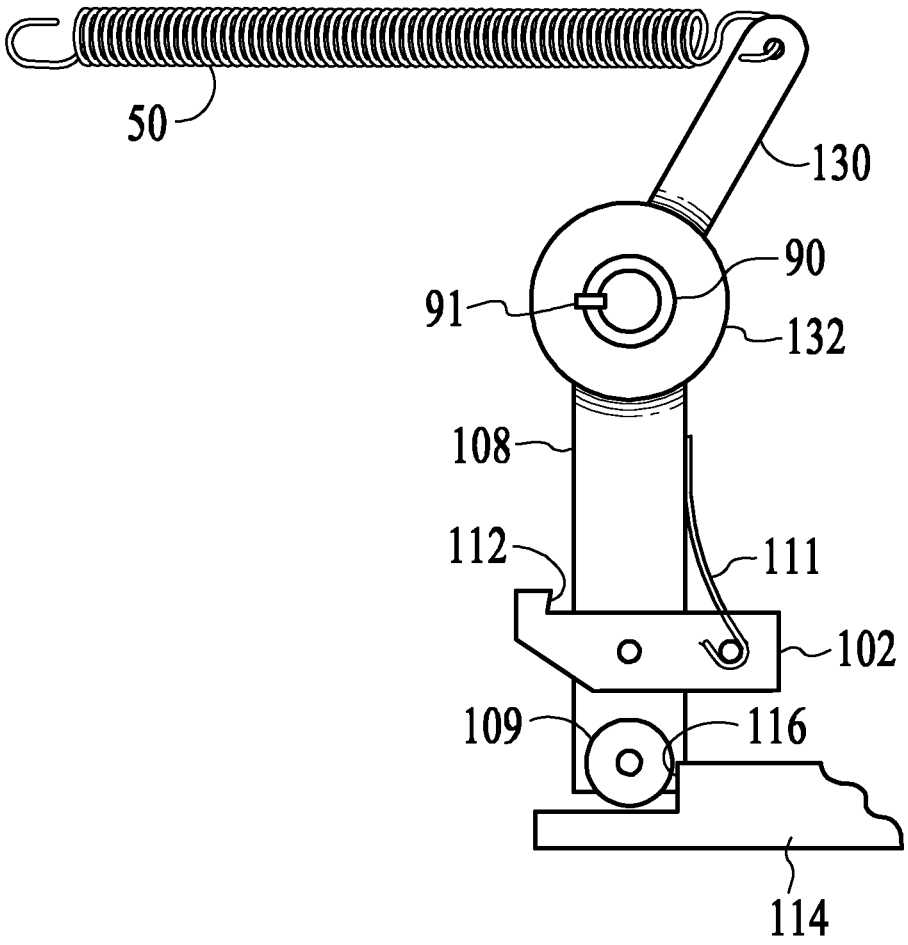
FIG. 8 is similar to FIG. 7. It shows a key, a catch, an electric switch, and a more detailed view of a trigger-centering spring, in accordance with one embodiment.
Figure 11:
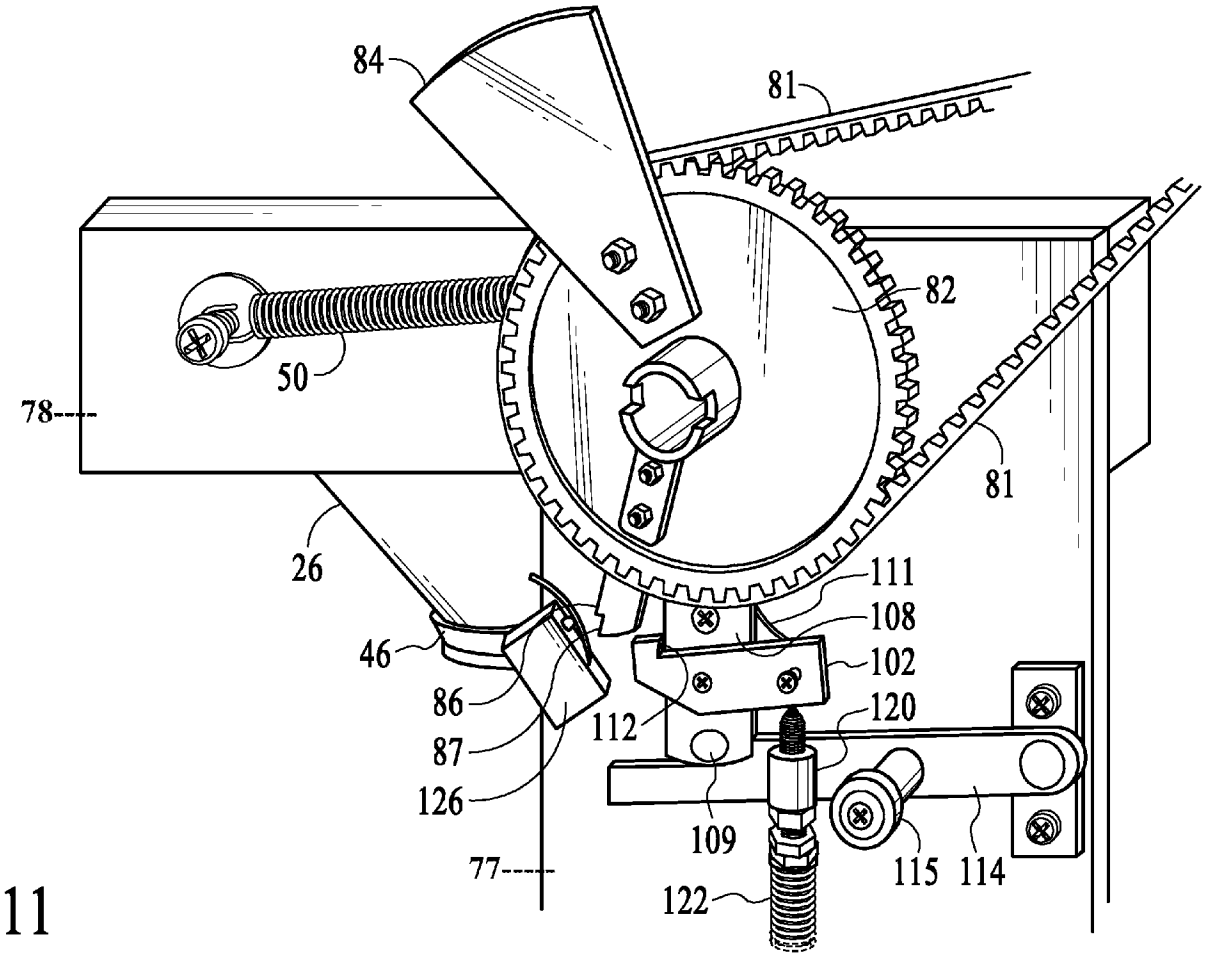
FIG. 11 shows a side-view from the right of the multi-part external mechanism for opening and closing the saucer when the saucer is normally locked closed, in accordance with one embodiment.
Figure 12:
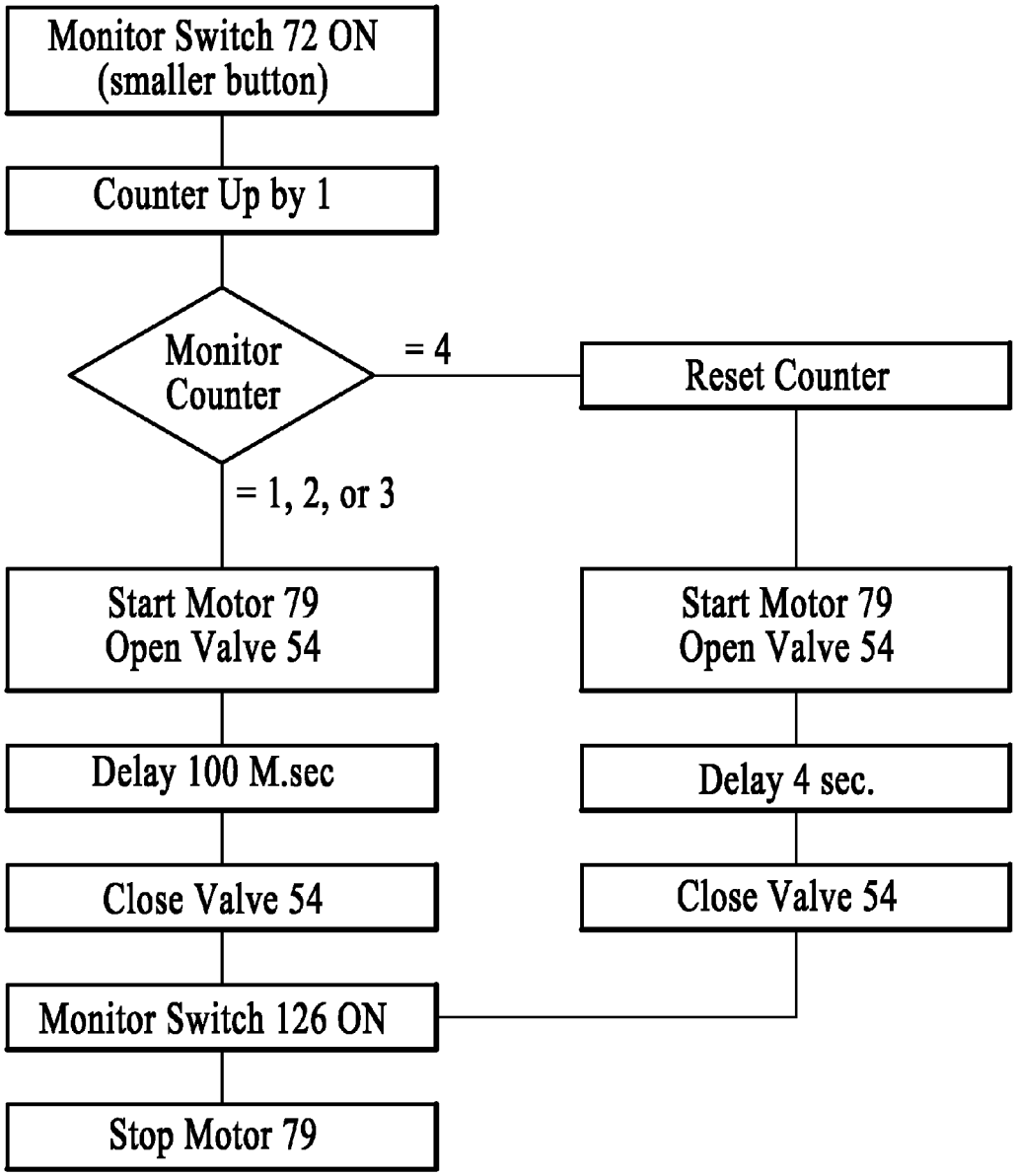
FIG. 12 is a flow chart of the operating steps that follow depression of a button to rinse the bowl, in accordance with one embodiment.

A timing wheel 82 is connected to a timing belt 81, as shown in FIGS. 7 and 8. Belt 81 is connected to a sprocket (not shown) of rotary motor 79 (FIG. 3). Wheel 82 rotates freely on saucer-pivoting shaft 90 and is connected to cam 84, as shown in FIGS. 1, 6, and 11.

In one embodiment, bottom outlet 32 was about 3.25 inches wide, considerably wider than siphon toilets and, when open, thereby much less likely to clog. When closed, it can (1) retain water, urine, solid human waste, and artificial test media in the bowl, and (2) prevent potentially volatile toxic or explosive mixtures of gases from entering a bathroom from an adjoining drain line. In one embodiment, the trap has the general shape of a saucer.

One embodiment was able to carry 100 test plastic balls an average distance of more than 12 meters (40 feet) with 1.0 to 2.0 liters of water. Another embodiment was able to carry 100 balls in excess of 18.3 meters (60 feet) with 1.0 to 2.0 liters (0.3 to 0.5 gallon) with a staggered flush.

Structures and Connections—FIGS. 1 and 2

Bowl 26 is an integral part of upper support structure 24. The bottom of bowl 26 protrudes downward through structure 24.

Structure 24 sits on and is connected to lower support structure 22. Structure 24 sits on the floor or ground 23 (FIG. 2) and is connected to an adjoining drain line 36. Waste passageway 34 is an integral part of the lower support structure. Bowl 26 and waste passageway 34 have bottom outlets that are aligned approximately vertically above an inlet to the adjoining drain line. Sealing ring 48 surrounds and is connected to the outside of the bowl near the bottom outlet of the bowl. The sealing ring may be made of compressible material. In one embodiment, it was made of Viton elastomer.

Bowl 26 (FIG. 1) has a front part 28 and a rear part 30. Front part 28 inclines 30 to 50 degrees forward and rear part 30 inclines 5 to 15 degrees rearward from the vertical. The front and rear parts are linear; they do not form convexities or concavities. In one embodiment, there can be an inclination in the front part of 40 degrees forward and the rear part of 10 degrees rearward. As mentioned, this lack of concavities and convexities (1) helps prevent feces and toilet tissue from sticking to those parts of the bowl and thereby makes them easier to rinse, and (2) permits rinse and flush water to fall with greater momentum.

Figure 5B:
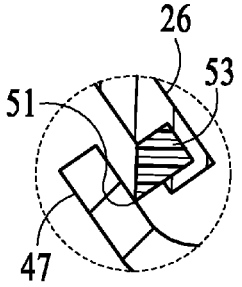
FIG. 5B shows detail of the saucer and sealing ring shown in FIG. 5A, in cross section.

Shaft 90 is connected to plate 49. Plate 49 is connected to stud 140 (FIG. 5A). Stud 140 is welded to a stiff plate 134 that is molded within, and entirely surrounded by, saucer or valve element 46. Sealing ring 48 has a wedge-shaped apex 51 and a roughly flat base 53. The base of ring 48 is press fitted into a groove. The groove surrounds the outside surface of bowl 26 above and close to bottom outlet 32, as shown in FIG. 5B. Apex 51 of ring 48 extends outward from the bowl. It is compressible and resilient. Thus forceful closure of saucer 46 forcefully compresses apex 51 against bowl 26, and thereby hermetically seals bottom outlet 32 of the bowl. Plate 49, stud 140, and the saucer-shaped valve element are shown in their fully open, vertically down positions in FIG. 2.

Electric controls 76 and a flushometer valve 54 are located within an accessory compartment 56 (FIG. 2). Valve 54 is connected to a pressurized water feed 52. Feed 52 has an inside diameter of about 12.50 mm (0.50 inch). Feed 52 can be regulated by a conventional anti-siphon valve, pressure regulator, and or anti-water hammer valve.

As show in FIGS. 2 and 3, spillway 64 is an aperture in an upper front part of bowl 26. Anti-splash ledge 66 is connected to the bottom of spillway 64. There is sufficient distance between spillway 64 and water outlets 62 to permit bowl contents, when large enough to overflow, to overflow without coming in contact with the water outlets. Thus, in the event of a drop in pressure in the normally pressurized water source, the separation between spillway 64 and water outlets 62 prevents bowl contents from being sucked into a drinking water line.

As shown in FIG. 3, a front part of a toilet seat 70 and a front part of a toilet rim 68 are approximately horizontally oriented. The rear parts of seat 70 and rim 68 are inclined upward and rearward and are connected to an immobile part of the upper toilet. An aperture in seat 70 and rim 68 is roughly centered above bottom outlet 32 of the bowl and inlet 36 of an adjoining drain line.

Structures and Connections—FIG. 3

As shown in FIG. 3, rim 68 is formed at the upper part of the bowl. Seat 70 sits on the rim. A button 72 and a button 74 are located on top of the rear of the toilet. The buttons are connected to electric control 76. Control 76 is connected to a motor 79 and to flushometer valve 54.

Valve 54 is connected to water feed 52 which is connected to a source of pressurized water, which is suitable for drinking. Valve 54 contains a diaphragm (not shown). The diaphragm is connected to a push rod 80. Rod 80 is connected to a push button 78, which is located on top of the toilet, adjacent to buttons 72 and 74. Manually depressing button 78 depresses rod 80 and manually opens valve 54.

Valve 54 is connected to water conduits 60. Conduits 60 run forward on the outside of both sides of bowl 26. At least two of conduits 60 enter the bowl from opposite directions adjacent each other. Conduits 60 end inside of the bowl as water outlets 62. Outlets 62 point in opposite directions the inside of bowl 26.

Spillway 64 is provided in an upper front part of bowl 26. There is sufficient distance between spillway 64 and outlets 62 to permit bowl contents to flow out of the bowl without coming into contact with outlets 62 or, in the event of a drop in water pressure, being sucked into drinking water. Anti-splash ledge 66 is connected to the bottom of spillway 64 to prevent turbulent rinse water from leaving the bowl.

Water conduits 60 end as adjacent water outlets 62 that point in opposite directions so that they can rinse areas of the bowl below, between, and beyond the outlets. This creates turbulence towards the front and rear mid-lines of the bowl where, due to the bi-lobed configuration of the human buttock, feces are prone to adhere.

Rigid plate 134 (FIG. 5A) stiffens saucer 46. The periphery of saucer 46 inclines upward and outward from the flat part of the saucer. A plain washer and a wave washer 138 and a plain nut and jam nut 136 secure plate 49 to stud 140.

Plate 49 and saucer 46 are shown pivoted clockwise, fully closed, upward, so that the peripheral part of saucer 46 is hermetically compressed against sealing ring 48.

As shown in FIG. 5B, sealing ring 48 has a wedge-shaped apex 51 and a roughly flat base 53. Ring 48 is press fitted into a groove. The groove surrounds the outside surface of bowl 26 above its bottom outlet 32. The apex faces outward from the bowl. Closure of saucer 46 forces a small area of periphery 47 of saucer 46 against a small area of apex 51.

Structures and Connections—FIG. 6

FIG. 6 shows a side-view from the right of a multi-part external mechanism for opening-and-closing saucer 46 shown in FIGS. 1, 2, and 5 when it is hermetically locked closed. The mechanism is located outside of structure 24 and passageway 34 (FIGS. 1 and 2).

A sprocket on a drive motor (not shown) is connected to a notched timing belt 81 (FIG. 6). The belt is connected to a notched timing wheel 82. Arm 86 and cam 84 are connected to wheel 82. One end of spring 50 is fastened to a wall of the toilet; the other end (not shown) is behind timing wheel 82 and is connected to the distal end of arm 130 (FIG. 1).

Arm 108 (FIG. 6) protrudes below wheel 82. Arm 108 is rotationally connected to trigger 102. One end of trigger 102 is formed as catch 112. The other end of trigger 102 is connected to the bottom of trigger-centering spring 111. The top of spring 111 is connected to arm 108. An inside surface of arm 108 is connected to roller 109.

The right end of arm 114 is rotationally attached to a wall 77. The other end of arm 114 is free. Roller 115 is connected the outside of arm 114. An adjusting screw 120 is welded to arm 114. Screw 120 is connected to bracket spring 122. Bracket spring 122 is connected to bracket 124. Bracket 124 is fastened to wall 77. Spring 111 urges arm 114 upwards against roller 109 on arm 108 and a rear end of trigger 102 upward. An electric switch 126 is connected to a wall 77 and to electric control 76 (FIG. 3).

Structures and Connections—FIG. 7

FIG. 7 is similar to FIG. 6, but without wheel 82 or belt 81 in order to show parts of the mechanism for opening and closing saucer 46. One end of arm 108 is connected to hub 132 and the other end to roller 109. Arm 130 is connected to one end of fully extended main spring 50. The other end of spring 50 is anchored to a wall 78 of the toilet. Spring 50 urges arm 130 and hub 132 counter-clockwise and locks arms 114 and 108 together and thereby locks saucer 46 in its normal position, fully closed.

Main spring 50 can be any mechanical, pneumatic, or magnet spring that opens the saucer fast enough to permit bowl contents to free fall into an adjoining drain line. In one embodiment, spring 50 was a coil spring. The speed with which spring 50 snaps open depends on the inertia of the above multi-part mechanism for opening saucer 46 and on the strength of spring 50. In one embodiment, saucer 46 snapped open within half of a second.

FIG. 8 shows details of the external multipart mechanism for opening and closing saucer 46. Arm 130 is connected to hub 132. Hub 132 surrounds saucer-pivoting shaft 90. Hub 132 is connected to a key 91. Key 91 is keyed to shaft 90 so that, when arm 108 rotates clockwise, hub 132 and shaft 90 rotate clockwise and thereby hermetically compress saucer 46 against sealing ring 48. Conversely, when spring 50 rotates hub 132 counter-clockwise, hub 132 rotates shaft 90 counter-clockwise and thereby rotates saucer 46 open, as shown in FIG. 2.

Roller 109 is connected to an inside lower part of arm 108. The free end of arm 114 is formed as catch 116. Roller 109 is engaged in catch 116. Trigger-centering spring 110 is connected to trigger 102 and to arm 108. Spring 50 urges trigger 102 to rotate to a position that is roughly at a 90° angle to arm 108.

Structures and Connections—FIG. 9

FIG. 9 shows a side-view from the right, minus the timing wheel and timing belt, of parts of the multi-part external mechanism for opening and closing saucer 46 when it 46 has been rotated counter-clockwise to the fully open position shown in FIG. 2. Spring 50 is fully contracted. Spring 50 has urged arm 130, hub 132, and arm 108 counter-clockwise so that roller 109 on arm 108 no longer engages catch 112 on arm 114. Consequently, spring 50 causes arm 108 and trigger 102 to a roughly horizontal position. As show in FIG. 10, relaxation of spring 111 permits trigger 102 to lock saucer 46 in a normally closed position.

Figure 10:
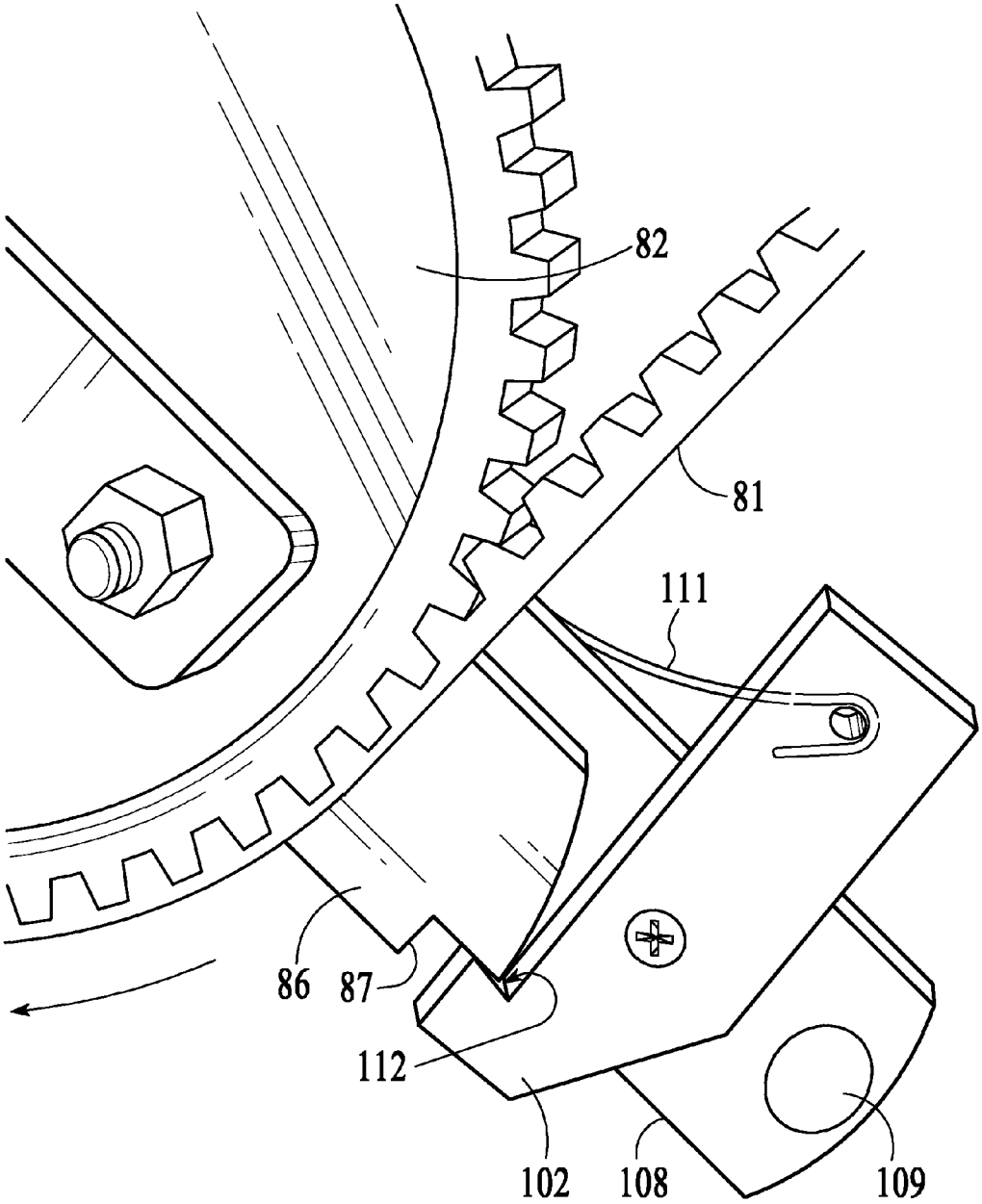
FIG. 10 shows a side view from the right of an arm on the timing wheel engaging the saucer-locking mechanism, in accordance with one embodiment.

FIG. 10 shows parts of the mechanism for opening and closing saucer 46. Arm 86 is connected to timing wheel 82. Clockwise rotation of wheel 82 engages catch 87 on arm 86 against catch 112 on arm 102 to rotate arm 102 clockwise, as shown by the arrow. Further rotation of timing wheel 82 causes arm 86 to activate lever 142 of switch 126 and thereby electronically terminate operations.

Structures and Connections—FIG. 11

FIG. 11 shows the positions of structures when saucer 46 is closed in its normal position, fully up, hermetically compressed against sealing ring 48. Catch 112 on arm 102 is disengaged from catch 87 on arm 86. Bracket spring 122 urges adjusting screw 120 upward against the rear end of arm 102. Upward pressure by spring 122 on screw 120 rotates the rear end of arm 102 upward and the front end of trigger arm 102 downward. Spring 122 urges the free front end of arm 114 upward to lock against roller 109 and thereby locks the mechanism for rotating saucer 46 in its fully closed position.

Consequently the toilet is ready (1) to expel urine or (2) solid human waste to a sewer, or (3) to test its ability to carry 100 test balls, or sausages, aka condoms filled with tofu in an adjoining laboratory drain line.

Expelling Urine to a Sewer—FIGS. 3, 4, 6, 8, 9, 11, and 12

FIG. 6 shows the multi-part external mechanism for opening and closing saucer 46, with saucer 46 normally locked hermetically closed. A user urinates into bowl 26 and depresses button 72. This automatically actuates the following events, summarized in FIG. 12.

Figure 4:
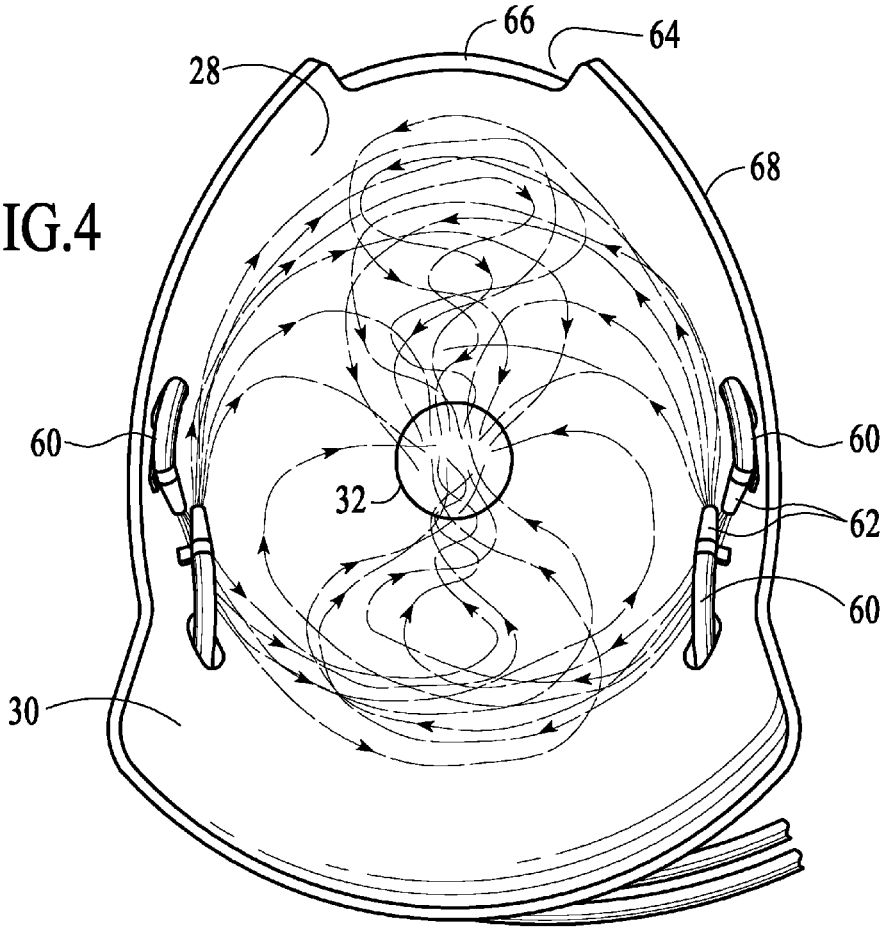
FIG. 4 shows a perspective view from above and to the rear of the toilet showing turbulent rinsing patterns created by two pairs of opposing water outlets, with the rinsing patterns converging towards the front and rear of the toilet, in accordance with one embodiment.

Electric control 76 (FIG. 3) opens flushometer valve 54 for a predetermined time, preferably about 100 milliseconds, to permit pressurized water to emerge from opposing water outlets 62 to create an extensive and turbulent rinse pattern, which detaches urine from the wall of bowl 26, as shown in FIGS. 3 and 4.

Depression of button 72 also actuates electric control to start motor 79 to rotate clockwise until saucer 46 is fully open as follows: Clockwise rotation of motor 79 rotates timing belt 81 clockwise. Clockwise rotation of belt 81 rotates wheel 82 clockwise. Continued clockwise rotation of wheel 82 causes cam 84 to depress roller 115. This depresses the front end of arm 114. This disengages catch 87 on arm 86 from catch 112 (FIG. 10) on arm 102 and thereby causes main spring 50 to snap closed. Relaxation of spring 50 pulls or snaps arm 130 on hub 132 counter-clockwise (FIGS. 7-9).

Rotation of hub 132 rotates key 91 on saucer pivoting shaft 90 counter clockwise and snaps arm 108 counter-clockwise to a roughly horizontal position (FIG. 9). This snaps plate 49 of saucer 47 vertically downward to its fully open position to permit urine and water to free fall into adjoining drain line 36 (FIG. 2). The water and urine gravitationally flow the length of drain line 36 to a sewer system, not shown. A volume of 200 to 300 ml (0.05 to 0.08 gallon) is adequate. The amount may be up to 250 ml (0.06 gallon). When released, apex 51 of seal ring 48 rebounds to a decompressed state within less than one second.

Further clockwise rotation of wheel 82 by motor 79 closes saucer 46 as follows: (1) Wheel 82 rotates arm 84 clockwise. (2) Clockwise rotation of arm 84 depresses roller 115 on arm 114. (3) Depression of arm 114 engages catch 87 on arm 86 with catch 112 on trigger 102 and presses the rear end of trigger 102 against bracket spring 122 so that the saucer is fully closed, as shown in FIGS. 1, 2, 5A, and 5B. (4) Motor 79 stops and (5) the operation terminates. The toilet is immediately available for a next user.

Expelling Solid Waste—Creation of Plash and Staggered Flush—FIGS. 2, 3, 7, 8, 12, and 13

Since there is normally no water in the bowl, a wet spot or plash of water is first required to cushion falling feces to prevent them from unduly adhering to the bowl. In one embodiment, there may be a 1.00 liter (0.25 gallon) plash. It is about 85 mm (3.45 inches) deep and has a surface area of about 140 mm by 165 mm (5.75 by 6.75 inches). This embodiment exceeds minimum ASME standards for wet spots.

To create the plash a user depresses manual push button 74, which (FIG. 13) opens valve 54 long enough (about 750 ms) to fill the bowl to a 1.0 liter (0.25 gallon) mark, not shown.

If this does not suit a user, the user can create a larger one as follows: The user depresses button 78 (FIGS. 2 and 3), which depresses push rod 80. The rod disengages the diaphragm in flushometer valve 54. This in turn opens valve 54 and permits a quantity of pressurized water to jet into bowl 26. The user holds button 78 down until there is 1.0 liter (0.25 gallon) of water in the bowl; enough to fill it to a mark (not shown). Later, the user can experiment with progressively smaller plashes. Eventually, the user may find an ecologically desirable 1.0 liter (0.25 gallon) plash is adequate.

Figure 13:
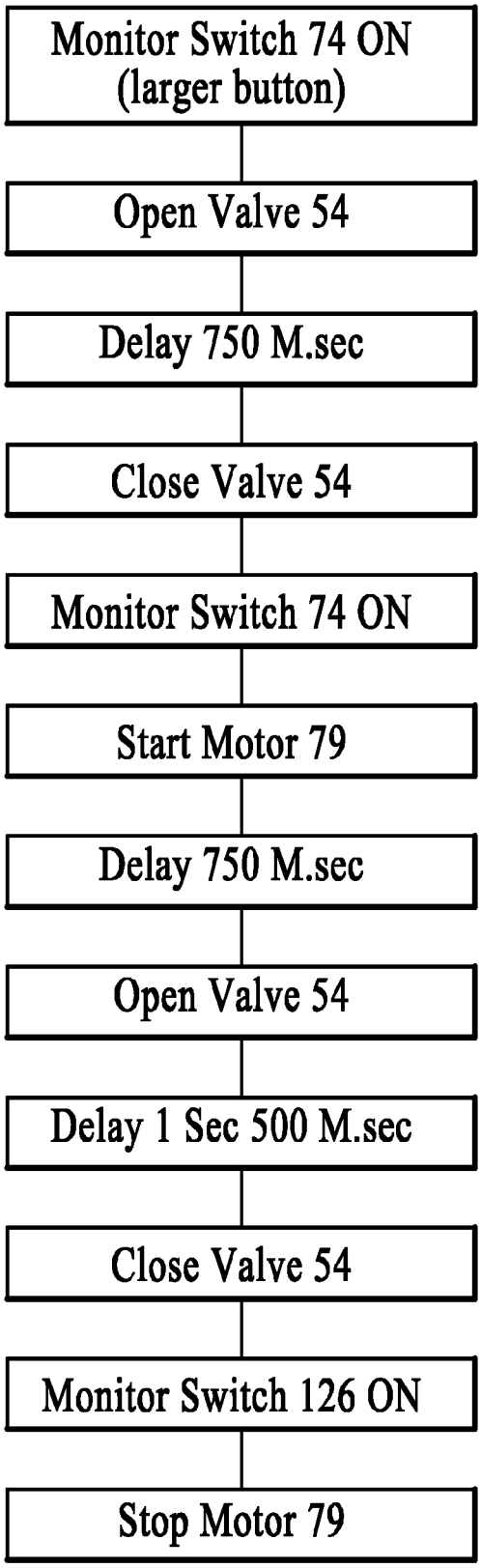
FIG. 13 is a flow chart of the operating steps of a staggered flush, actuated by depression of a button, to expel solid human waste to a sewer, or to test how well the toilet can carry 100 plastic balls in a laboratory drain line, in accordance with one embodiment.

When ready to expel solid human waste to a sewer, the user depresses button 74 again to actuate a staggered or two-part flush, as also shown in FIG. 13: Valve 54 opens again for the first part of the flush, about 750 milliseconds, to rinse bowl 26 free of solid human waste with about 1.0 to 2.0 liters (0.25 to 0.50 gallon) of water.

Concurrently motor 79 rotates the timing belt and timing wheel 82 clockwise until saucer 46 has opened to its fully down position, as described. Opening saucer 46 permits the plash and the first part of the flush, plus the solid human waste, to free fall into the adjoining drain line.

As further indicated in FIG. 13, while the saucer is open and the solid human waste is moving in the drain line, valve 54 automatically opens for a second predetermined time, preferably about 500 milliseconds, to introduce a second quantity of water, about 1.0 to 2.0 liters (0.25 to 0.5 gallon) into the drain line behind the moving solid waste. (While saucer 46 is open, valve 54 can open for a predetermined longer time, preferably about one and half seconds, to release a larger second quantity of water, about 3.0 liters (0.75 gallon) into the drain line while the solid human waste is still moving.) The total water consumption is about 5.0 to 6.0 liters (1.25 to 1.50 gallons).

Releasing the second quantity of water into the drain line while the solid human waste is still moving carries the solid waste further than if both quantities of water were to enter the drain line together.

The saucer automatically closes as described in detail above. The operation for expelling solid human waste to a sewer with a staggered flush is terminated. The toilet is ready for the next user.

Since bowl 26 progressively narrows from top to bottom, the free-falling feces, toilet tissue, urine, and wet spot converge so that their total diameter becomes considerably less than that of passageway 34. Consequently, they are unlikely to adhere to waste passageway 34.

Testing Toilet to Carry ASME-Rated Plastic Balls in Laboratory Drain Line with Staggered Flush To test the toilet, a tester inserts 100 plastic balls into the normally empty bowl and actuates button 74. Motor 70 opens the saucer, as described, so that the balls free-fall into an adjoining laboratory drain line. While the saucer is open, valve 54 opens for about 750 milliseconds to release a predetermined amount of water into the drain line to impart more momentum to the balls. After about a 750 millisecond delay, while the balls are moving in the drain line, motor 70 re-opens valve 54 for about 1.5 seconds to release pressurized water into the drain line to impart additional momentum, and, thus greater carry to the balls. Then valve 54 closes and saucer 46 closes to its normal closed vertically upright position. The motor stops so that the operation is terminated and the toilet is immediately available for additional operations.

As mentioned, the ASME standard states that toilets that may be legally offered for sale in residences and business with an IAPMO rating in the US and Canada on condition they can carry 100 balls an average of 12.2 meters (40 feet), or more, with 6.0 liters (1.6 gallons) or less of water.

One embodiment can carry 100 balls in excess of 18.3 meters (60 feet) with about 1.00 to 2.00 liters (0.3 to 0.5 gallon) of water. Apparently, no prior-art toilet carried this number of balls so far with less than 6.0 liters (1.6 gallons).

Per-Person-Per-Day Water Consumption

Some dual-flush siphon and wash-down toilets use as much as 18 liters (4.76 gallons) per-person-per-day when conventionally used. Most single-flush siphon toilets, when used as recommended by their makers and most single flush wash-down toilets use up to 30.0 liters (8.0 gallons) per person per day. In contrast, one embodiment of my toilet uses about 9.8 liters (2.6 gallons) per day per person when used as recommended.

CONCLUSIONS, RAMIFICATIONS, AND SCOPE

Accordingly the reader will appreciate various aspects of the present invention have several advantages such as water efficiency and cleanliness. For example, the steep-sided bowl, having none of the conventional convexities and concavities helps prevent feces from adhering to the bowl. Opposing water outlets rinse the bowl most turbulently where feces are more prone to adhere. Thus, the outlets are more water efficient and the bowl more likely to remain clean. Furthermore, urine adherent to the bowl can be rinsed into the drain line with about 250 ml (0.07 gallon) of water.

The saucer is normally hermetically compressed against the bowl, so that the contents of the bowl remain in the bowl and sewer gases remain in the sewer. One embodiment has a saucer that has been tested and opened and then hermetically closed about 75,000 times.

The saucer opens with sufficient rapidity that urine, feces, and or toilet tissue in the bowl can free fall into an adjoining drain line. Thus, unlike current indoor toilets, a wet spot is not necessary when a user merely urinates.

If the toilet is provided in a public bathroom, a laser beam can be directed across the bathroom's doorway so that, whenever a user leaves without flushing, the interruption of the beam will automatically trigger the above operation for flushing solid waste.

The manual push button can be repeatedly actuated to release up to seven liters of water in the bowl to flush toilet tissue that may come rest in the drain line adjoining a business if the drain line is not regularly be flushed by showers, dish washers, clothes washers, sinks, etc., as are drain lines adjoining residences. (Toilets use less than 30% of water used indoors in residences.)

Although the above description contains many details, these details should not be construed as limiting the scope of the present invention, since they are merely illustrative examples of some of the embodiments. Many additional embodiments are possible. For example, the drive motor can be directly connected to the timing-wheel assembly, thus eliminating the need for and expense of a timing belt. In one embodiment, the toilet can utilize a battery capable of powering several thousand automated flushes during a power outage or in buildings not provided with electric power. The battery can automatically be recharged from the same power source that powers electric controls 76 so that the battery remains charged.

For buyers whose wet spot needs are accommodated by 1 liter (0.25-gallon) of water, a maker can dispense with the manual push button, the manual push rod, and the diaphragm in valve 54, thereby reducing its manufacturing costs.

The waste passageway and lower support structure can be up to about 300 mm (12 inches) taller. A manufacture can sell such tall toilets to burgeoning populations for whom today's toilets are uncomfortably low and to myriads of people afflicted with a wide variety of painful disabilities that hamper them when they sit on conventional toilets.

A variety of shock absorbers can be used to dampen an upward thrust of arm 108 and thereby prevent the main spring from shocking and damaging moving parts which open and close the saucer. This will extend the useful life of these parts.

In lieu of a fluoro-elastomer, the sealing ring can be made of a variety other resilient materials, such as varieties of rubber or equivalent polymers that can be compressed many times and promptly rebound to their pre-compression state. Instead of the saucer compressing the point of an apex, in another embodiment it can compress a resilient fold.

The seat, rim, and cover can be conventionally sloped for initial buyer acceptance. In various embodiments the seat, bowl, and waste passageway can be made of a variety of corrosion resistant materials which include, but are not limited to, vitreous china, plastics, metals, or anodized aluminum coated with PTFE.

The weight of a toilet is important to makers, distributors, plumbers, and handy owners. The bowl, upper support, waste passageway, and lower support structure can be made of light corrosive-resistant plastics, or anodized aluminum coated with PTFE. This will reduce the weight of some embodiments of the present invention to about half that of current indoor toilets.

The bowl and waste passageway can be made of vitreous china, the surface of which has a finish which repels urine, so that no rinsing of urine is required. Such a finish permits saving of about 250 ml (0.07 gallon) of water each time a male uses the toilet for urination alone.

Thus, the scope is determined by the appended claims and their legal equivalents, rather than by the examples given.

What is claimed:

1. A mechanical trap toilet, comprising:

(a) a toilet bowl for receiving human waste, (b) said bowl having a bottom outlet for communicating with a drain line, (c) a flap valve mechanism including a valve element having (1) a closed state where said valve element covers said bottom outlet to prevent waste in said bowl from moving down through said bottom outlet to said drain line; and (2) an open state where said valve element is moved away from said bottom outlet for allowing said waste in said bowl to move down through said bottom outlet to said drain line under the force of gravity, (d) liquid flush means for flushing liquid waste from said bowl by moving said sealing element to said open state and concurrently supplying a predetermined quantity of water into said bowl to flush said liquid waste into drain line through said outlet, and thereafter moving said valve element back to said closed state, and (e) solid flush means for flushing solid waste, or solid plus liquid waste, from said bowl by moving said valve element to said open state and concurrently supplying a predetermined first quantity of water into said bowl to flush said solid waste, or said solid plus liquid waste, into said drain line through said outlet, and after a predetermined delay, and while said valve element is still open and before said valve element begins to close, supplying a predetermined second quantity of water into said bowl to flush said solid waste, or said solid plus liquid waste, into said drain line through said outlet, and thereafter moving said valve element back to said closed state, whereby solid waste will be subjected to a first flush to cause said solid waste to begin moving out of said toilet and a second flush to cause said moving solid waste to continue moving.

2. The toilet of claim 1 wherein said liquid flush means comprises a first manually operable member and said solid flush means comprises a second manually operable member.

3. The toilet of claim 1 wherein said solid flush means is arranged to supply said first and said second quantities of water into said bowl through the same orifice in said bowl.

4. The toilet of claim 1 wherein said valve element is rotationally mounted so that it is moved from said closed state to said open state by rotating it away from said outlet of said bowl.

5. The toilet of claim 1 wherein said valve element is a circular member and said outlet has a resilient seal around a periphery thereof.

6. The toilet of claim 1 wherein said first and second quantities of water are each one to two liters in volume.

7. A method of flushing waste more efficiently, comprising:

(a) providing a toilet bowl for receiving human waste, said bowl having a bottom outlet for communicating with a drain line, (b) providing a flap valve mechanism including a valve element having a closed state where said valve element covers said bottom outlet to prevent waste in said bowl from moving down through said bottom outlet to said drain line; said valve element also having an open state where said valve element is moved away from said bottom outlet for allowing said waste in said bowl to move down through said bottom opening to said drain line under the force of gravity, (c) flushing liquid waste from said bowl by moving said valve element to said open state and concurrently supplying a predetermined quantity of water into said bowl to flush said liquid waste into drain line through said outlet, and thereafter moving said valve element back to said closed state, and (d) flushing solid waste, or solid plus liquid waste, from said bowl by moving said valve element to said open state and concurrently supplying a predetermined first quantity of water into said bowl to flush said solid waste, or said solid plus liquid waste, into said drain line through said outlet, and after a predetermined delay, and while said valve element is still open, supplying a predetermined second quantity of water into said bowl to continue to flush said solid waste, or said solid plus liquid waste, through said drain line, and thereafter moving said valve element back to said closed state, whereby solid waste will be subjected to a first flush to cause said solid waste to begin moving out of said toilet and a second flush to cause said moving solid waste to continue moving.

8. The toilet of claim 7, further including providing a first manually operable member for flushing said liquid waste and a second manually operable member for flushing said solid waste.

9. The toilet of claim 7 wherein said flushing solid waste is arranged to supply said first and said second quantities of water into said bowl through the same orifice in said bowl.

10. The toilet of claim 7 wherein said sealing element is rotationally mounted so that it moves from said closed state to said open state by rotating it away from said outlet of said bowl.

11. The toilet of claim 7 wherein said valve element is a circular member and said bottom outlet has a resilient seal around a periphery thereof.

12. The toilet of claim 7 wherein said first and second quantities of water are each one to two liters in volume.

13. A mechanical trap toilet, comprising:

(a) a toilet bowl for receiving human waste, (b) said bowl having a bottom outlet for communicating with a drain line, (c) a flap valve mechanism including a valve element having (1) a closed state where said valve element covers said bottom outlet to prevent waste in said bowl from moving down through said bottom opening to said drain line; and (2) an open state where said valve element is moved away from said bottom outlet for allowing said waste in said bowl to move down through said bottom outlet to said drain line under the force of gravity, (d) liquid flush means for flushing liquid waste from said bowl by moving said valve element to said open state and concurrently supplying a predetermined quantity of water from an orifice in said bowl to flush said liquid waste into drain line through said outlet, and thereafter moving said valve element back to said closed state, and (e) solid flush means for flushing solid waste, or solid plus liquid waste, from said bowl by moving said valve element to said open state and concurrently supplying a predetermined first quantity of water into said bowl from said bowl orifice to flush said solid waste, or said solid plus liquid waste, into said drain line through said outlet, and after a predetermined delay, and while said valve element is still open, supplying a predetermined second quantity of water from said bowl orifice into said bowl to continue to flush said solid waste, or said solid plus liquid waste, through said drain line, and thereafter moving said valve element back to said closed state, whereby solid waste will be subjected to a first flush to cause said solid waste to begin moving out of said toilet and a second flush to cause said moving solid waste to continue moving.

14. The toilet of claim 13 wherein said liquid flush means comprises a first manually operable member and said solid flush means comprises a second manually operable member.

15. The toilet of claim 14 wherein said first and second flush means comprise first and second pushbuttons, respectively.

16. The toilet of claim 13 wherein said valve element is rotationally mounted so that it is moved from said closed state to said open state by rotating it away from said outlet of said bowl.

17. The toilet of claim 13 wherein said valve element is a circular member and said outlet has a resilient seal around a periphery thereof.

18. The toilet of claim 13 wherein said first and second quantities of water are each one to two liters in volume.

* * * * *

UNITED STATES PATENT AND TRADEMARK OFFICE

CERTIFICATE OF CORRECTION

PATENT NO. : 9,045,887 B2
APPLICATION NO. : 13/244359
DATED : June 2, 2015
INVENTOR(S) : Conor O'Malley It is certified that error appears in the above-identified patent and that said Letters Patent is hereby corrected as shown below:

On the Title Page

Item (75): Change Inventor's Residence City from "San Diego" to --San Jose--.

Signed and Sealed this
Twenty-second Day of September, 2015

Michelle K. Lee

Michelle K. Lee
*Director of the United States Patent and Trademark Office*